United States Patent [19]

Blezard

[11] 4,007,611

[45] Feb. 15, 1977

[54] YARN AND METHOD KNITTING SAME

[75] Inventor: Robert C. Blezard, Woonsocket, R.I.

[73] Assignee: Smithfield Fibers, Inc., Lincoln, R.I.

[22] Filed: Apr. 16, 1973

[21] Appl. No.: 351,577

Related U.S. Application Data

[62] Division of Ser. No. 83,588, Oct. 23, 1970, Pat. No. 3,748,874.

[52] U.S. Cl. ..... 66/195; 66/169 R; 66/169 A

[51] Int. Cl. ..... D04b 21/00

[58] Field of Search ..... 66/86, 1, 202, 87, 190

[56] References Cited

UNITED STATES PATENTS

| | | | |
|---|---|---|---|
| 1,860,030 | 5/1932 | Hinchliff | 66/169 |
| 2,020,197 | 11/1935 | Meiwald | 66/8 |
| 2,031,707 | 2/1936 | Hanff | 66/169 X |
| 2,049,845 | 8/1936 | Lepine | 66/169 X |
| 2,064,074 | 12/1936 | McNamee | 66/169 |
| 2,137,692 | 11/1938 | Linke | 66/193 |
| 2,143,230 | 1/1939 | Seim | 66/1 |
| 2,213,720 | 9/1940 | Seim | 66/1 |
| 3,221,520 | 12/1965 | Bassist | 66/87 |
| 3,568,277 | 3/1971 | Mattingly | 28/72 |
| 3,568,278 | 3/1971 | Mattingly | 28/72 |

OTHER PUBLICATIONS

Paling, "Warp Knitting Technology," 2nd Ed., 1965, Columbine-Press, London, England, pp. 334–335.

*Primary Examiner*—Ronald Feldbaum
*Attorney, Agent, or Firm*—Salter & Michaelson

[57] ABSTRACT

A knitted yarn and a method for knitting the yarn. The yarn comprises two strands formed into successive stitches alternately disposed about two needle axes. Alternate strands form the successive stitches along each axis. Each stitch on one axis is drawn through a preceding stitch on that axis. As a result, each stitch on each strand passes through an adjacent stitch formed of the other strand.

Each stitch in a strand is formed at a single or one of two reciprocating latch needles which pull the newly formed stitches in each strand through preceding stitches in the other strand and cast off the preceding stitches. Then the needles extend to accept the next stitches formed in the strands. The yarn knitting apparatus feeds strands at a controlled rate to service bars which reciprocate and oscillate over the needles to form the stitches at the needles alternately each time the needles reciprocate.

2 Claims, 13 Drawing Figures

FIG. 2
(A)
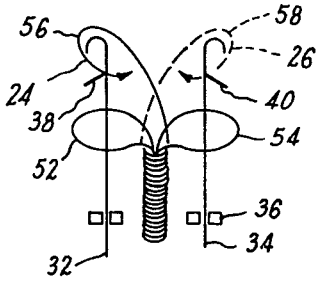
(B)
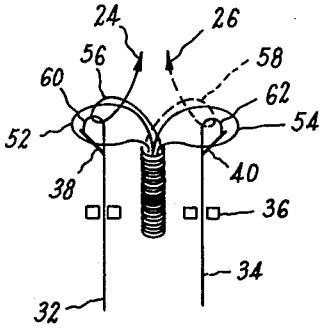
(C)
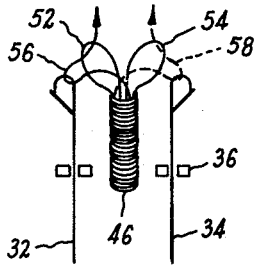
(D)
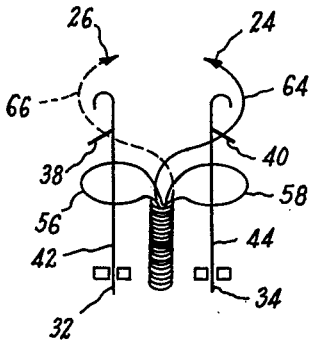
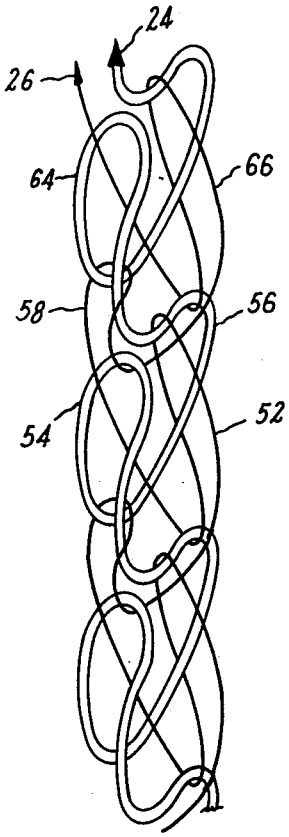
FIG. 3

FIG. 4
(A)
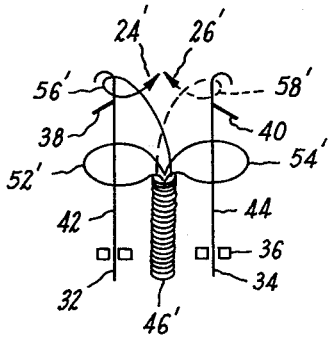
(B)
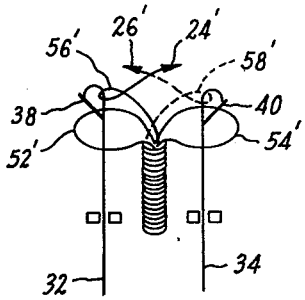
(C)
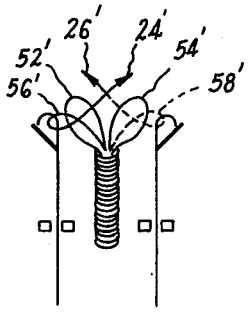
(D)
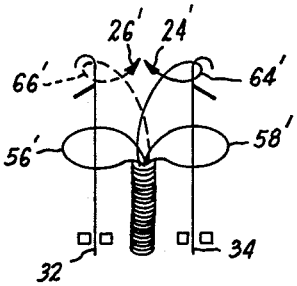
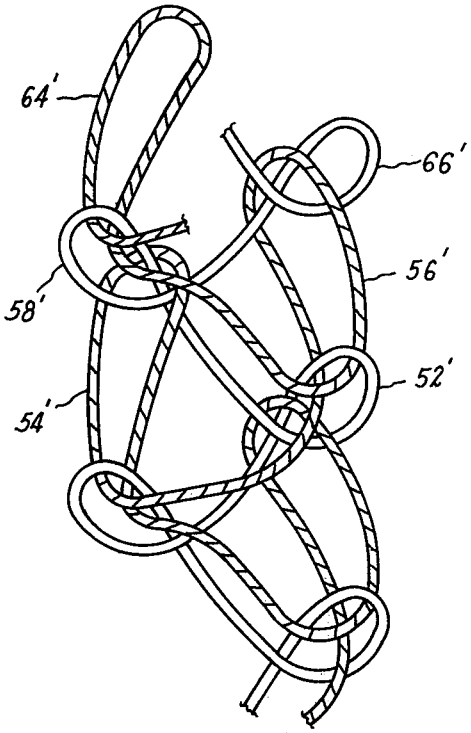
FIG. 5

YARN AND METHOD KNITTING SAME

BACKGROUND OF THE INVENTION

This is a division of application Ser. No. 83,588, filed Oct. 23, 1970 and entitled "Yarn Knitting Machine" which has matured into U.S. Pat. No. 3,748,874.

This invention generally relates to textile manufacturing and more specifically to a novel yarn, and a method and apparatus for manufacturing such a yarn.

In the following discussion, the phrase "knitted yarn" means any product formed in accordance with this invention from a continuous strand comprising a fiber, filament or combination of such fibers or filaments. Within the meaning of this invention, strands may include both textile and non-textile materials.

Yarns manufactured in one conventional textile manufacturing process, known as draw-twisting, comprise two or more twisted strands or plies. A positive feed mechanism supplies the strands to a drawing area at a controlled rate. A traveller on a vertically reciprocal ring in the drawing area guides the strands onto a bobbin which rotates about a vertical axis. The combined motion of the bobbin and ring causes the strands to twist into a finished form. Once the bobbin fills, the process is interrupted to replace the bobbin. Then the twisted yarn on the full bobbin is usually transferred to another twisting operation or a final storage cone.

However, yarns made by twisting have some disadvantages. For example, when twisted yarn is cut, it tends to unravel and splay. In some situations, the yarn must be treated to prevent this condition, thereby complicating the overall manufacturing process. As the finished yarn is accumulated on a take-up bobbin, which has a limited capacity and which performs an integral role in the twisting process, the operator must stop the draw-twisting machine to replace the bobbin when it fills. These interruptions, of course, reduce manufacturing efficiency. Further, twisted yarn has an inherent internal torque. As a result, it is subject to kinking and breaking in subsequent use. In addition, material knitted with such yarn tends to skew because the yarn tends to knit on a bias.

In another manufacturing process, known as braiding, a number of strands are interwoven or braided to form yarn. Two sets of feed spools move in opposite directions on two tracks while paying out the strands that make up the yarn. Each spool moving in one direction passes on alternate sides of the spools moving in the other direction. As a result, each strand interweaves with all other strands. Braided yarns are not subject to the unraveling of twisted yarns. However, they are inherently inelastic and, therefore, not used whenever some elastically is desired. Moreover, the size and weight of the fiber and its supporting elements limit the operational speed and size of a braiding machine. If the strands were taken directly from storage cones on the tracks, the machine would be unacceptably large and slow because storage cones generally weight several pounds.

Therefore, the braiding process includes an intermediate step of transferring small quantities of this strand (e.g., ½ ounces) from storage cones to the relatively small feed spools which weigh about two ounces when they are full. When a spool empties, the operator stops the machine and replaces that spool, or all spools if appropriate. He usually ties old and new strands together if continuous yarn is desired. With these interruptions, the average production rate is relatively low.

Even with the intermediate step, braiding machines produce yarn at an upper limit usually measured in inches per minute. Furthermore, this upper limit is decreased if the strand size decreases because the strand diameter forms a significant portion of the length of finished yarn.

A given braiding or twisting machine can usually produce only a narrow range of yarn sizes. Differently sized rings must be used to manufacture significantly different twisted yarns, but these rings are not readily interchanged in a given machine. Similarly, the mechanisms in a braiding machine cannot usually be interchanged simply and limit the range of yarn sizes.

Therefore, it is one object of this invention to provide a novel yarn.

It is another object of this invention to provide a novel yarn which does not unravel when it is cut.

It is yet another object of this invention to provide an inherently elastic novel yarn.

Still another object of this invention is to provide a method and apparatus for manufacturing knitted yarn at greater rates than those available with braiding machines.

Yet another object of this invention is to provide an economical method and associated apparatus for manufacturing knitted yarn.

Still another object of this invention is to provide a method and apparatus for substantially continuously manufacturing knitted yarn.

Yet another object of this invention is to provide a method and apparatus for knitting a wide range of yarn sizes from different strands.

SUMMARY

My novel yarn is knitted, and it comprises two strands formed into a sequence of open or closed stitches. Successive stitches in each strand are alternately disposed along two parallel axes, with successive stitches on each axis being alternately formed from the two strands. Each stitch is drawn through a preceding stitch on the axis to form an interlocked, knitted yarn.

The stitches are wrapped about two reciprocating needles. As each needle retracts, it draws the new stitch through the preceding stitch formed in the other strand about that needle. With further needle movement, the preceding stitches are freed from the needles and thereby cast-off over the new stitches. A novel yarn knitting machine reciprocates the needles and loops the strands around the needles in synchronism.

This knitted yarn provides a number of important advantages. The ends do not splay when the knitted yarn is cut. Because it is knitted, the internal torque of twisted yarns is substantially eliminated. The knitted yarn is inherently elastic and, as described later, the degree of elasticity is controllable. Manufacturing rates are greatly improved because neither the strand supply unit nor the finished yarn take-up is involved in the process. This allows the machine to operate substantially continuously without requiring any operations equivalent to either the spooling steps in braiding or repeated bobbin replacement in draw-twisting. For example, the machine continues to knit yarn as new take-up bobbins are replaced.

This invention is pointed out with particularity in the appended claims. A more thorough understanding of the above and further objects and advantages of this invention may be attained by referring to the following detailed description taken in conjunction with the accompanying drawings.

BRIEF DESCRIPTION OF THE DRAWINGS

FIG. 2 schematically illustrates one operating sequence for forming knitted yarn;

FIG. 3 depicts the knitted yarn formed by the sequence shown in FIG. 2;

FIG. 4 schematically illustrates another operating sequence for forming knitted yarn;

FIG. 5 depicts the knitted yarn formed by the sequence shown in FIG. 4;

DESCRIPTION OF AN ILLUSTRATIVE EMBODIMENT

A. General Discussion

Figures 1, 1A:
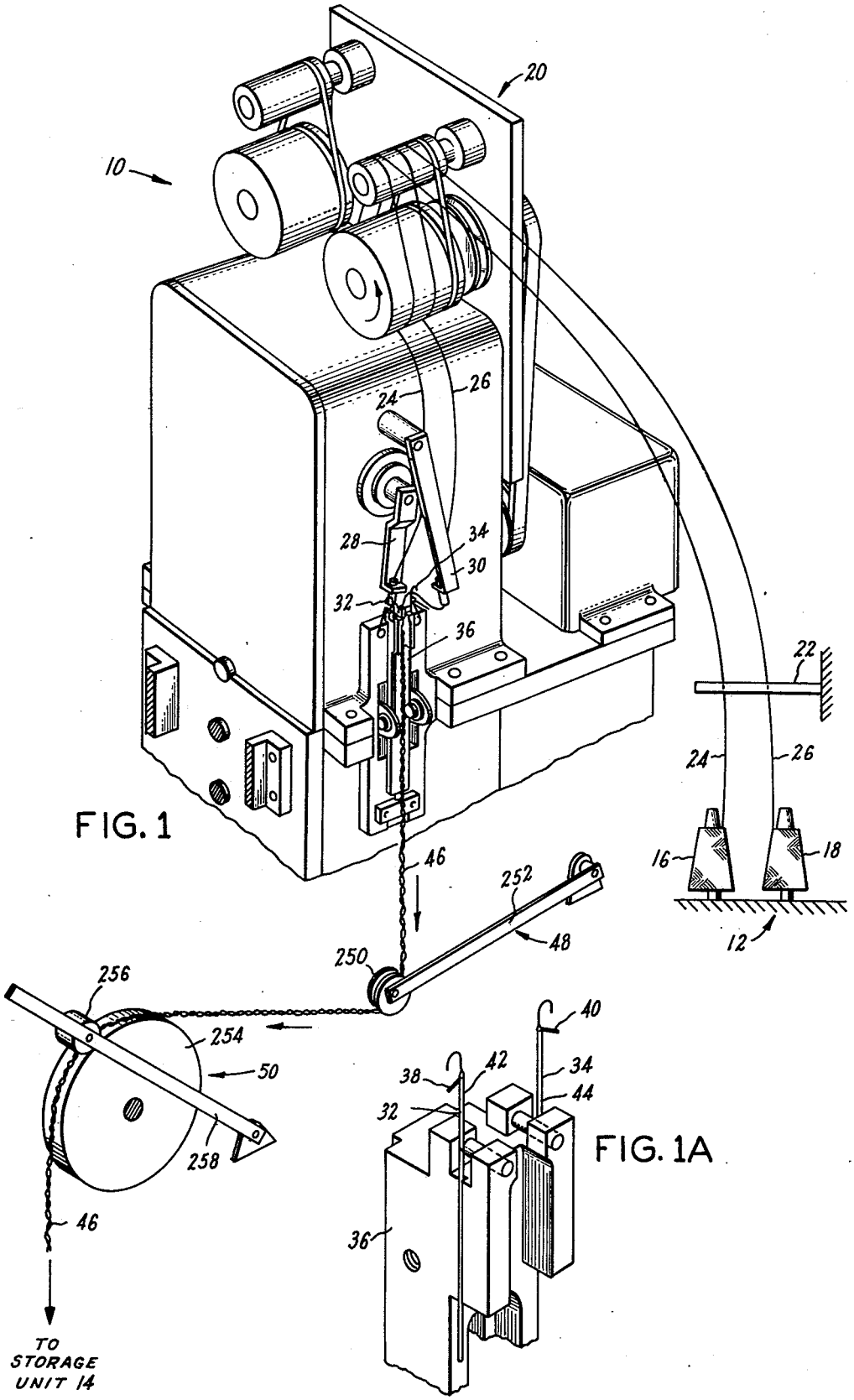
FIG. 1 shows a machine for knitting yarn in accordance with this invention.
FIG. 1A is an enlarged detail view.

In accordance with my invention, a yarn knitting machine 10, shown in FIG. 1, transforms two strands from a supply location 12 into knitted yarn which is stored at a yarn storage location 14. Generally, storage cones 16 and 18 store the strands at the storage location 12. A strand feeding mechanism 20 draws strands 24 and 26 from the cones 16 and 18 through a conventional tensioning mechanism 22 for delivery to the knitting machine 10.

The feeding mechanism 20 supplies the strands 24 and 26 to service bars 28 and 30, respectively, which deposit the strands around vertical latch needles 32 and 34 as stitches. Each service bar simultaneously oscillates about, and reciprocates along, a horizontal support axis to perform this function as described later.

The two latch needles 32 and 34 reciprocate simultaneously along vertical needle axes in a supporting needle slider block 36 below the service bars 28 and 30. The needle 32 includes a pivoted latch 38; the needle 34, a pivoted latch 40. Each time the needles reciprocate, they draw new stitches through preceding stitches disposed around needle stems 42 and 44, to form finished yarn 46.

The finished yarn 46 passes through a tensioning unit 48 and take-up drive assembly 50 driven by the knitting machine 10. At this point, the knitted yarn is completed and no further processing is necessary.

B. Yarn Structure and Method

FIG. 2 illustrates the sequence for forming a circular yarn shown in FIG. 3. In FIG. 2A, the latch needles 32 and 34 are fully elevated and the latches 38 and 40 are open. Previously knitted stitches 52 and 54 lie around needle stems 42 and 44 below the latches 38 and 40, respectively.

The service bars (28 and 30 in FIG. 1) form two open stitches 56 and 58 around the needles as the service bars move the strands in the directions indicated by the arrows on the individual strands 24 and 26 again. As a result, the strand 24 extends from the yarn 46 rearwardly behind the needle 32, and then to the front to form an open stitch 56. In this arrangement, the strand 24 does not cross by itself between the needles. The strand 26 forms a stitch 58 around the needle 34 in a similar manner.

As the needles 32 and 34 retract downwardly in the needle slider block 36, the latches 38 and 40 close and positively capture the stitches 56 and 58 in eyes defined by the latches 38 and 40 and respective needle hooks 60 and 62. In FIG. 2B, the closed needles 32 and 34 are about to draw the stitches 56 and 58 through the previously formed stitches 52 and 54 which are cast-off as shown in FIG. 2C as the needles complete their downward movement. As the stitches are cast-off, they form a portion of the finished yarn 46. The tension on the finished yarn 46 produced either by its own weight or by the take-up tensioning unit (48 in FIG. 1) which assures that stitches which are cast-off clear the needles 32 and 34.

Now the needles 32 and 34 elevate again and pull the new stitches 56 and 58 with them past the old stitches 52 and 54. Initially, the latches remain closed and the upward needle movement extends the stitches 56 and 58 and tends to tighten strands and reduce the size of the previous stitches 52 and 54. The final stitch size depends upon the strand increment which is fed to the service bars each time the needles reciprocate in relation to the tension on the finished yarn 46.

As the latches 38 and 40 clear the slider block 36, the stitches 56 and 58 open them and slip down the needle stems 42 and 44 as shown in FIG. 2D. During this portion of the operating cycle, the service bars 28 and 30 shown in FIG. 1 start forming another pair of stitches around alternate needles as shown in FIG. 2D. That is, the service bar 28 deposits the strand 24 in a stitch 64 around the needle 34 while the service bar 30 deposits the strand 26 in a stitch 66 around the needle 32 simultaneously. Hence, each service bar forms a sequence of stitches in its respective strand and deposits these stitches alternately around one or the other of the needles and their respective axes. For example, the service bar 28 forms a sequence of stitches 54, 56 and 64 in the strand 24 and deposits them alternately around the needles 32 and 34. Further, each pair of stitches, such as stitches 54 and 56 circumscribe both needles and their axes to form the open stitches.

The resulting yarn 46, shown in FIG. 3, therefore comprises two strands 24 and 26. Strand 24 includes stitches 54, 56 and 64 in sequence, while the strand 26 includes corresponding stitches 52, 58 and 66. A given stitch in one strand, such as the stitch 56, passes through a stitch 52 in the other strand 26 which precedes a stitch 58 corresponding to the given stitch 56. The resulting yarn comprises two strands which form interlocked chains with each strand forming alternate links or stitches in each chain and corresponding links in each chain being formed of different strands.

As the yarns in FIGS. 3 and 5 have many common advantages, the operating sequence in FIG. 4 for producing the knitted yarn with closed stitches is described before discussing these advantages. The machine in FIG. 1 can be modified so the service bars 28 and 30 deposit the strands as closed loops or bights around each needle to form closed stitches. With these stitches, the knitting machine produces a rectangular knitted yarn shown in FIG. 5 in accordance with the sequence of FIG. 4.

Referring specifically to FIG. 4A and using a prime to indicate elements which are modified with respect to FIG. 2, the needles 32 and 34 are fully elevated and the latches 38 and 40 are open. Previously knitted stitches 52′ and 54′ lie around the needle stems 42 and 44 below the latches 38 and 40, respectively. The service arms (28 and 30 in FIG. 1) deposit two closed stitches 56′ and 58′ around the needles as the arms move in the directions indicated by the arrows on the individual strands. As a result, the strand 24′ extends from the yarn 46′ rearwardly behind the needle 32 and then to the front to cross itself and completely encircles the needle 32 as a closed stitch 56′. The strand 26′ forms the closed stitch 58′ in a similar manner.

As the needles 32 and 34 retract downwardly in the needle slider block 36, the latches 38 and 40 close and positively capture the stitches 56′ and 58′. In FIG. 4B, the closed needles 32 and 34 are about to draw the closed stitches 56′ and 58′ through the previously formed stitches 52′ and 54′ which are cast-off as shown in FIG. 4C as the needles complete their downward movement as previously described.

Now the needles 32 and 34 elevate again pulling the new stitches 56′ and 58′ with them past the old stitches 52′ and 54′ with the same results as occur in the sequence of FIG. 2. In the meanwhile, the service arm 28 reciprocates and oscillates to deposit the strand 24′ completely around the needle 34 as a closed stitch 64′. Simultaneously, the service arm 30 forms the strand 26′ into a closed stitch 66′ about the needle 32. Hence, as the needles 32 and 34 retract again, they pull the stitches 64′ and 66′ through the stitches 58′ and 56′, respectively.

The resulting yarn is shown in FIG. 5. The strand 26 is formed into closed stitches 52′ and 58′ and 66′ while the strand 24′ is formed into closed stitches 54′, 56′ and 64′. As was true in the yarn shown in FIG. 3, a given stitch 58′ formed in one strand 26′ is drawn through a stitch 54′ preceding a stitch 56′ in the other strand 24′ which corresponds to the given stitch 58′.

Structurally, the yarns in FIGS. 3 and 5 differ because the individual strands circumscribe each needle during the sequence of FIG. 4 whereas each successive pair of stitches circumscribe both needles in sequence of FIG. 2. This variation alters the overall yarn configuration. The yarn formed with open stitches has a substantially circular cross-section; the yarn formed with closed stitches in FIG. 5 has a rectangular cross-section. Furthermore, the stitches in FIG. 3 tend to be more densely packed than the loops in FIG. 5.

Both yarns remain intact when they are cut and eliminate the prior unravelling because the stitches are interlocked. Both yarns are inherently elastic, and the degree of elasticity is easily variable by altering the feed rate. If the feed rate increases the incremental length of the strand fed to the needles each time the needles reciprocate, the resulting yarn has more elasticity. An increased relative feed rate also produces a bulkier yarn. The resulting yarn also has a certain texture. This texture is produced by the mechanical orientation of the strands and cannot be altered because the strands are interlocked. A selection between the yarns for an application depends upon several factors. Aesthetic characteristics may be paramount in some circumstances. The inherent frictional characteristics of the yarn may be important. In this regard, the circular yarn seems to produce less sliding friction than the rectangular yarn. The previously described differences in stitch density or the increased surface area of the rectangular knitted yarn may be important in still other applications.

The resulting yarns in FIGS. 3 and 5 are both formed of strands which may be twisted or braided yarns of the prior art. However, the cones 16 and 18 in FIG. 1 may also contain yarn manufactured in accordance with my invention. When knitted yarn is manufactured in this manner, its relative bulk is increased further. Further, one or both service arms may feed several distinct strands to the needles simultaneously.

C. The Yarn Knitting Machine

Both yarns in FIGS. 3 and 5 can be manufactured on the knitting apparatus shown in FIGS. 1 and 6–10. This specific knitting machine embodiment is readily adapted to knit two yarns simultaneously. As the elements for knitting each yarn are substantially identical, the emphasis in the following discussion is directed toward an understanding of knitting yarn 46 produced on one side of the machine.

The yarn knitting machine is disposed in a housing 100 including a horizontal support 102. A drive motor 104 mounted on the support 102 rotates a cam shaft 106 through a conventional belt and pulley system 107. The motor also drives an input shaft 108 for a torque converter 110 through another belt and pulley system 112 driven by the cam shaft 106. The torque converter 110 controls the speed of an output shaft 114. Such torque converters are well known in the art, one example being a Zero-Max torque converter manufactured by the Zero-Max Co., Minneapolis, Minnesota. A secondary horizontal support 116 spaced above the support 102 carries the torque converter 110 so the output shaft 114 and the yarn feeding mechanism 20 are aligned. A third belt and pulley system 118 links the output shaft 114 and the feeding mechanism 20.

Figure 6:
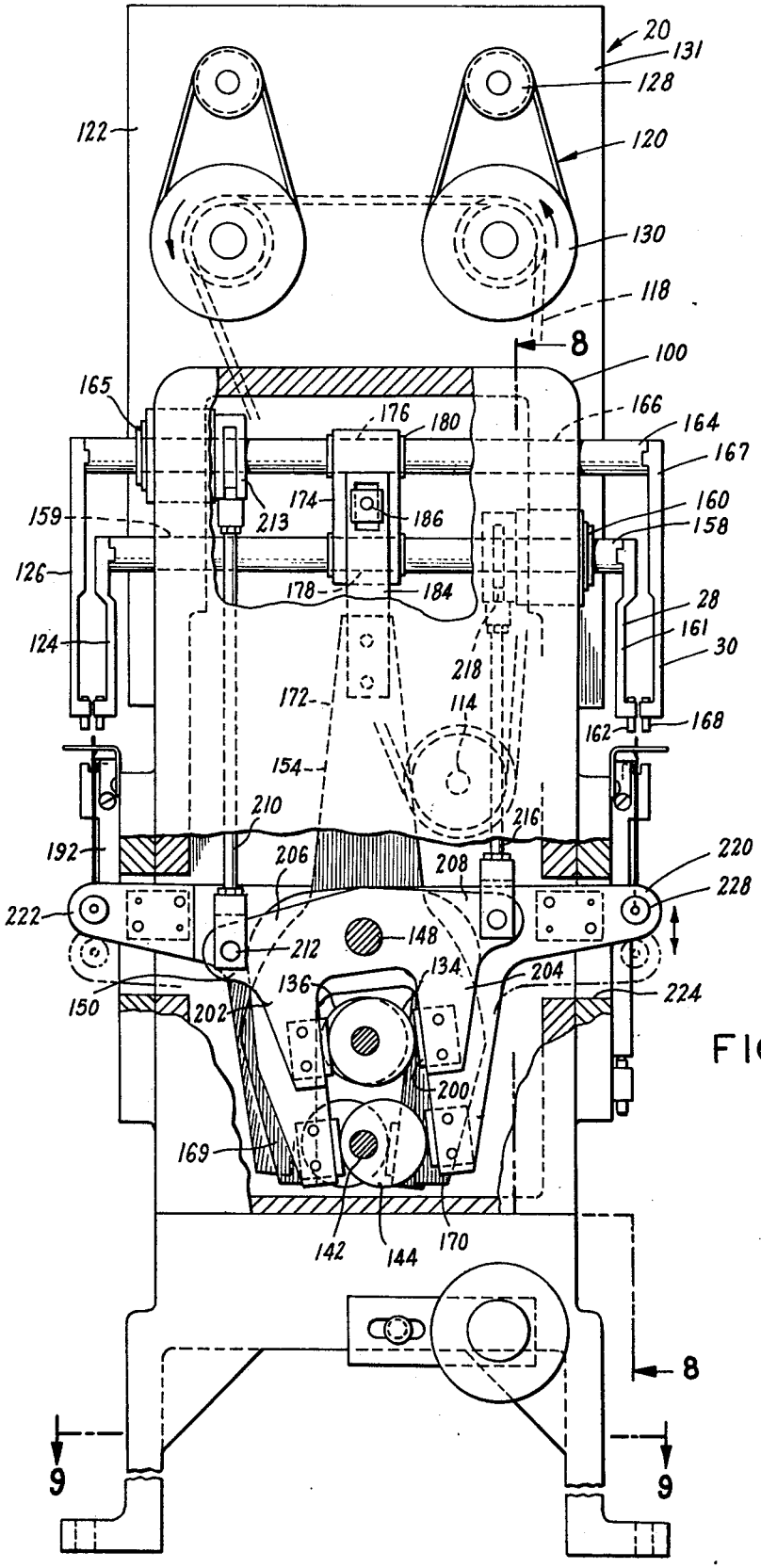
FIG. 6 is a front view of the knitting machine shown in FIG. 1, partially broken away.
Figure 7:
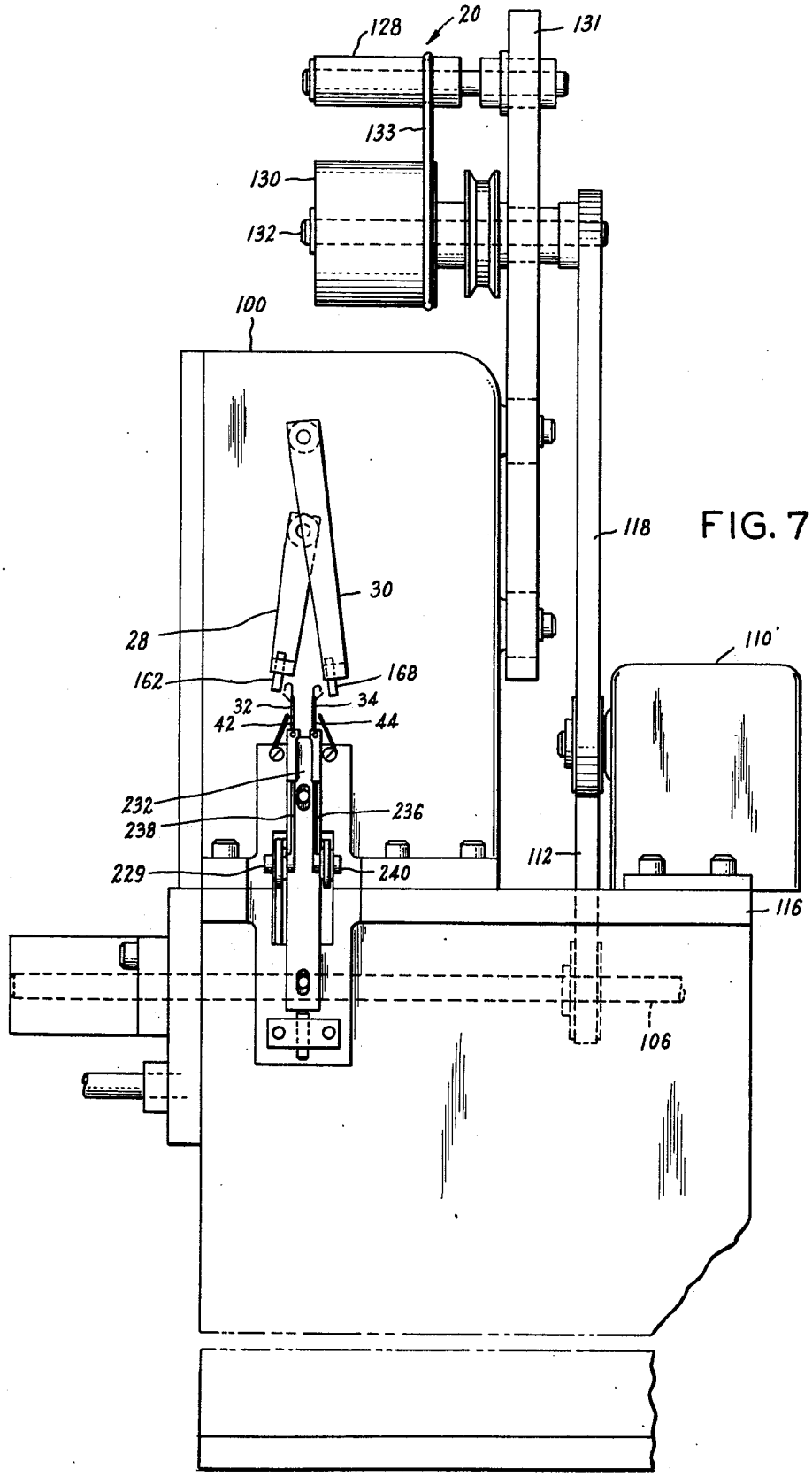
FIG. 7 is a side elevation.

As the yarn knitting machine shown in these FIGS. 6 and 7 can manufacture two yarns simultaneously, the feeding mechanism 20 comprises two feeding units. A feeding unit 120 supplies strands to the service bars 28 and 30 while another feeding unit 122 supplies strands to service bars 124 and 126 used in knitting the other yarn. In this specific embodiment, the third belt and pulley system 118 links both feeding units 120 and 122 so identical feed rates exist.

With specific reference to the feeding unit 120, an idler feed roller 128 and a driving feed roller 130, both of constant diameters, are mounted in parallel on a vertical support plate 131. The driving feed roller 130 rotates with a shaft 132 driven by the belt and pulley arrangement 118 while another belt 133 couples the roller 128 and spindle 130. The strands are normally wrapped about the periphery of both the feed rollers 128 and 130 several times before being fed to the service bars 28 and 30. As the motor 104 drives the remaining elements in the knitting machine including the service bars 28 and 30 and the needles 32 and 34 at constant rates, varying the angular velocity of the output shaft 114 alters the rate at which the feeding unit 120 continuously supplies strands to the service bars each time the needles 32 and 34 reciprocate to thereby vary its bulk and elasticity.

The knitting machine may also comprise other types of feeding units. For example, the feeding unit 120 may include a second set of feed rollers analogous to the feed rollers 128 and 130 so the feeding unit 120 supplies strands to the service bars separately. Variations in the relative feed rates can be made by interchanging driving rollers of different diameters. Still other types of apparatus may be used to feed strands to the knitting machine at a controlled rate.

Guides for the strands may be interposed between the feeding unit 120 and the service arms 28 and 30. Such guides are known in the art and are not shown.

Figure 8:
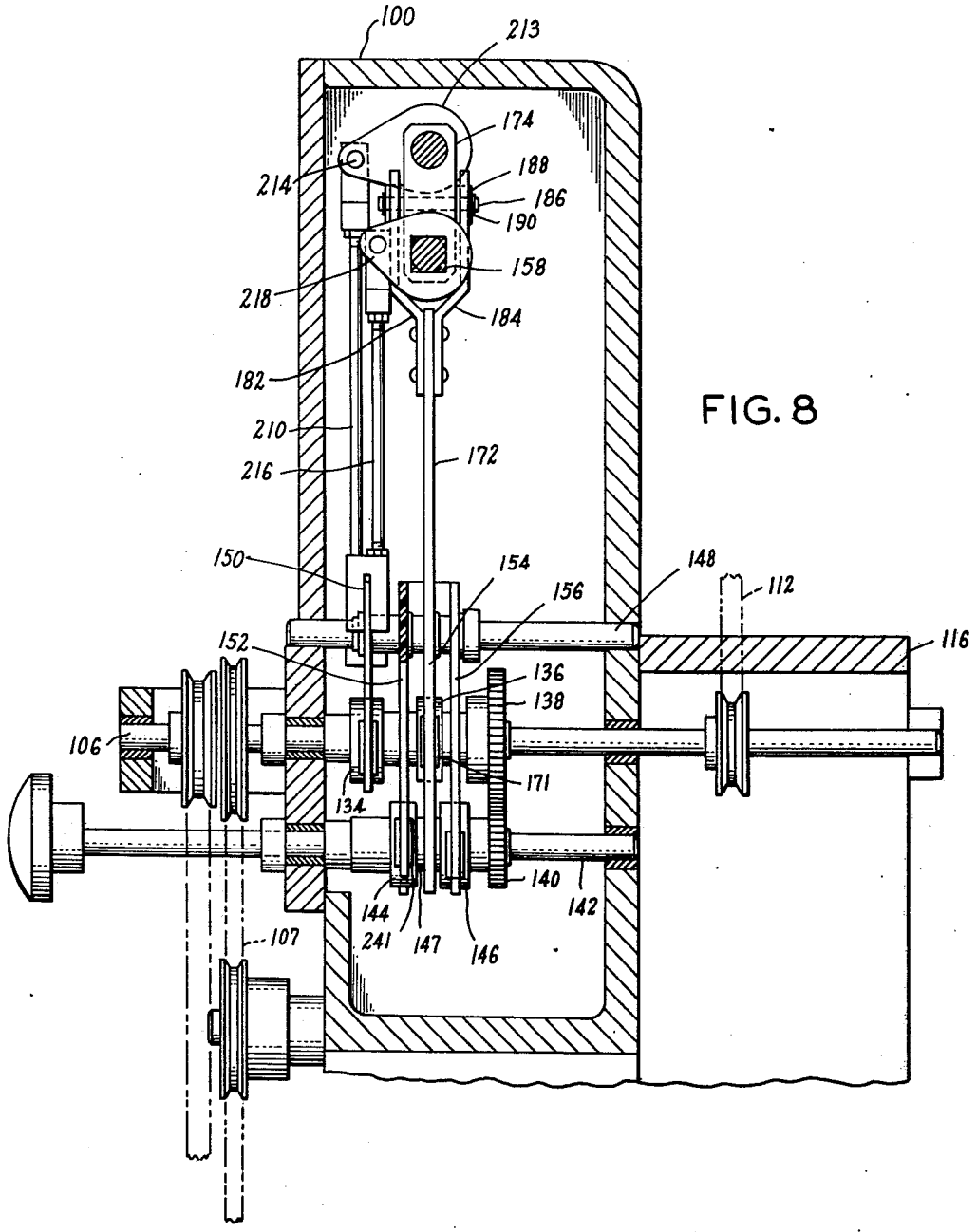
FIG. 8 is a cross-sectional view taken along lines 8—8 in FIG. 6.

As previously indicated, the service bars 28 and 30 oscillate about and reciprocate along horizontal axes simultaneously to form stitches. Both service bars are driven by the motor 104 through a series of cams and levers. (FIGS. 6 and 8)

The cam shaft 106 supports two spaced eccentric cams 134 and 136 and a pinion 138 for driving an idler gear 140 mounted on a second cam shaft 142 at twice the speed of the cam shaft 106. The shaft 142, which is vertically aligned under the cam shaft 106, carries another pair of spaced, eccentric cams 144 and 146. Spacers, such as the spacer 147 located directly below the cam 136 separate the cams so each is horizontally offset from the others. Each cam drives a lever mounted on a pivot shaft 148 parallel to and vertically aligned over the cam shafts 106 and 142. These levers are designated as a service bar lever 150, needle lever 152, throw-bar lever 154 and needle lever 156.

The service bars 28 and 124 are mounted on a lower throw bar 158 which rides in bushings 159 and 160 located in opposite sidewalls of the housing 100. The service bar 28 comprises an arm 161 which is rigidly affixed to the end of the lower throw bar 158. A horizontally offset cylindrical guide 162 at the lower end of the arm 161 carries the strand 24 as shown in FIG. 2.

An upper throw bar 164 rides in bushings 165 and 166 in the opposite sidewalls of the housing 100 and is vertically aligned over and parallel with the lower throw bar 158. This upper throw bar 164 supports the service bars 30 and 126 at opposite ends thereof. The service bar 30 comprises an arm 167 which is rigidly affixed to the end of the upper throw bar 164. An offset cylindrical guide 168 at the lower end of the arm 167 carries the strand 26 shown in FIG. 2.

The throw-bar lever 154 reciprocates the throw bars 158 and 164 along their respective horizontal axes simultaneously under the influence of the cam 136. A pair of bifurcated fingers 169 and 170 formed on the throw-bar lever 154 support shoes 171 which tangentially engages the cam 136 at diametrically opposed portions. As the cam 136 rotates, it oscillates the throw-bar lever 154 about the pivot shaft 148. An integral upper arm 172 on the throw-bar lever 154 engages a yoke 174 with parallel upper and lower journals 176 and 178 for engaging the throw bars 158 and 164, respectively. Snap rings 180 in circumferential grooves in each throw bar capture and center the yoke 174 on both throw bars. As a result, the throw bars 158 and 164 can oscillate about their axes in the yoke 174. However, when the yoke 174 is displaced horizontally, it carries both throw bars 158 and 164.

A pair of offset arms 182 and 184 couple the throw bar lever arm 172 and the yoke 174. A transverse pin 186 through the yoke 174 between the throw bars 158 and 164, bushings 188 formed on the arms 182 and 184 and snap rings 190 provide a conventional pivotal connection between the arms 182 and 184 and the yoke 174. Therefore, as the throw-bar lever 154 oscillates about the pivot shaft 148, it reciprocates the throw bars 158 and 164 and the four attached service bars simultaneously.

Although the service bars 28 and 30 move simultaneously with the service bars 124 and 126, their motion relative the needle slider block 36 is out of phase with the motion of the service bars 124 and 126 relative to an associated needle slider block 192. This produces some relative timing differences which are more specifically described later with reference to FIG. 11.

The concurrent oscillating motion for the service bars is provided by the cam 134, the service bar lever 150 and associated linkage. Shoes 200 supported by bifurcated arms 202 and 204 on the lever 150 tangentially engages the cam 134 so the lever 150 oscillates about the pivot shaft 148. The service bar lever 150 also comprises horizontally and oppositely extending arms 206 and 208 on a line through the pivot shaft 148. Each arm engages a linking mechanism which oscillates the throw bars 158 and 146 about their axes.

Specifically, a fixed link 210 is pivotally connected to the arm 206 by a pin 212 and to crank 213 by another pin 214. The crank 213, in turn, is affixed to rotate the throw-bar lever 164 about its axis but not to interfere with any axial motion. Such connections are known. A similar link 216 connects a crank 218 on the throw-bar lever 158 to the arm 208.

As the cm 134 rotates and elevates the arm 206, the link 210 and the crank 213 rotate the throw bar 164 clockwise when viewed from the service bars 28 and 30. Simultaneously, the arm 208 lowers and rotates the throw bar 158 counterclockwise.

In this configuration, with the cams 134 and 136 both mounted on the cam shaft 106, the throw bars and service bars oscillate and reciprocate at the same rate. Therefore, the service bars move substantially circularly and produce the closed stitches in the yarn shown in FIG. 3.

The remaining cams 144 and 146 reciprocate the needles with the separate, but identical, needle levers 152 and 154 oppositely mounted on the pivot shaft 148. The needle lever 152 comprises a horizontally extending arm 220 while the lever 154 by virtue of its reversed position, comprises an oppositely extending arm 222 when both levers are mounted on the pivot shaft 148.

With specific reference to the mechanism for reciprocating the needles 32 and 34, the arm 220 extends through an opening 224 in the housing sidewall to emerge beside the needle slider block 36. An offset arm 225 (FIG. 10) on the arm 220 emerges from the housing on the other side of the needle slider block 36. Each arm supports a bushing 228 in an aperture 230, the bushings engaging the latch needles 32 and 34.

The needle slider block 36 (FIG. 7) comprises a body portion 232 and two spaced, vertical ways 238 and 236 for supporting the stems 42 and 44 on the needles 32 and 34. The stems 42 and 44 terminate at elbows 239 and 240, respectively, which are individually supported by the bushings 228.

The needle lever 152 also comprises shoes 241 which tangentially engage the cam 144 to oscillate the needle lever 152 in response to cam rotation. As the bushings 228 pivotally support the needles 32 and 34, the oscillatory motion of the arms 220 and 222 is translated into a reciprocal needle motion as the needles slide in their respective ways. Furthermore, as the cams are mounted on the cam shaft 106, the needles reciprocate at a rate which is twice the oscillating rate for the throw bars 158 and 164.

The knitting apparatus is easily adapted to knit the yarn shown in FIG. 5. The operator merely interchanges the cam 136 and the spacer 147 and moves the shoe 171 to a lower position. With this modification, the cam 136 rotates at twice the rate of the cam 134. As a result, the throw bars 158 and 164 reciprocate at twice the rate of oscillation, and the service bars wrap their respective strands in a "FIG.-8" as closed stitches about each needle.

Figure 11:
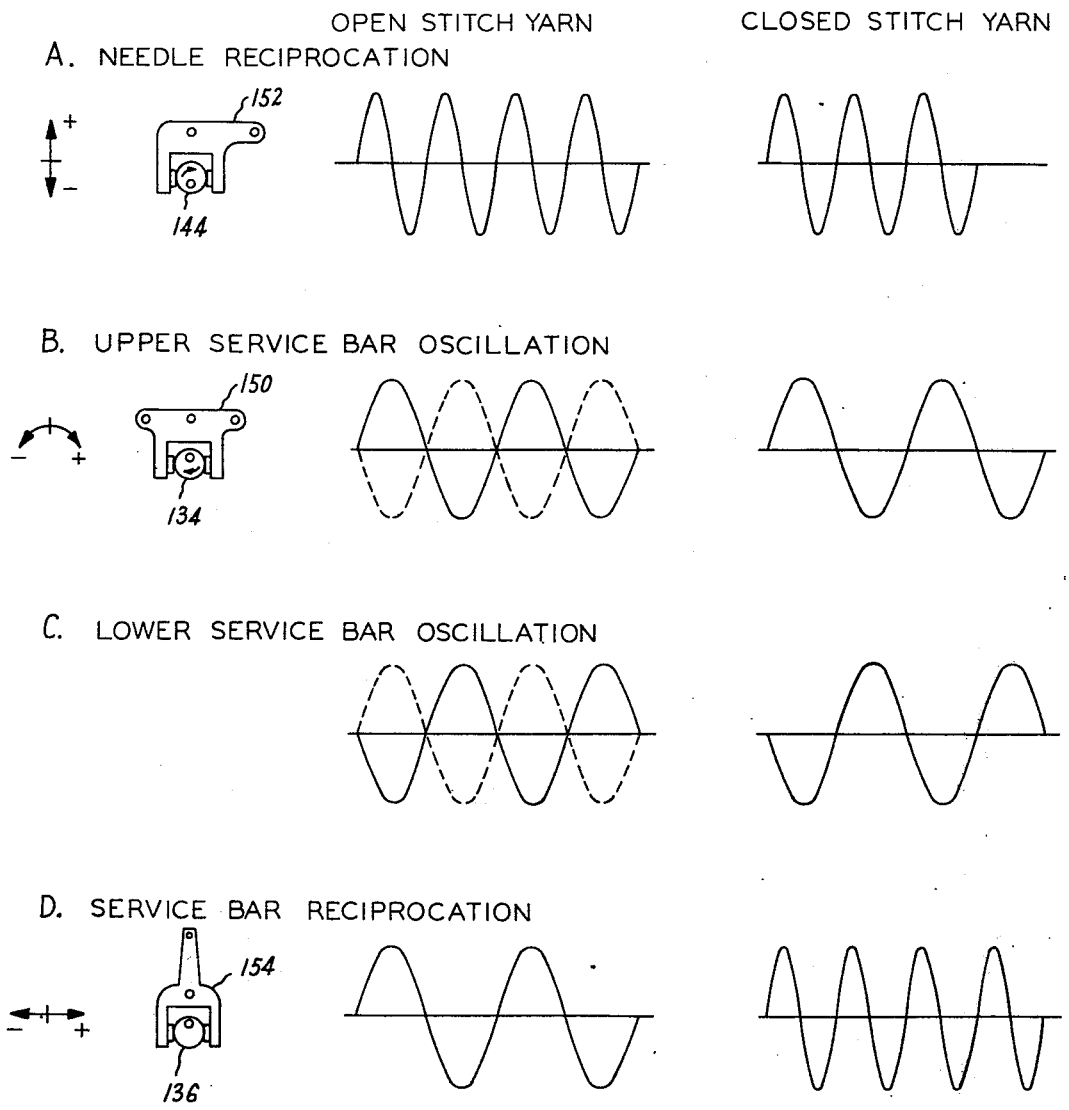
FIG. 11 is a machine timing diagram.

A still more thorough understanding of the operation of the knitting machine shown in FIGS. 1 and 6–10 may be obtained by referring to FIG. 11 which shows the cam timing diagrams and the relative orientation of each cam at a given instant in time. This figure is limited primarily to the operation of the needles 32 and 34.

As shown in FIG. 11A, the cam 144 drives the needle lever 152 starting at a mid-point with the positive going trace of the resulting curves indicating upward displacement of the needles. Both the needles reciprocate sinusoidally about the mid-point with respect to time at a constant rate for both the open and closed stitch yarns.

FIG. 11B represents the oscillation of the upper throw-bar 164 and service bar 30 with reference to central position with clockwise rotation or displacement being represented by the positive-going traces. As the cam 134 is mounted on the upper cam shaft 106, a complete oscillation occurs each time the needles reciprocate twice. Furthermore, as shown by FIG. 11C, the lower throw bar 158 oscillates at the same rate at the upper throw bar, but in an opposite direction. As a result, the cylindrical guides 162 and 168 on the service bars 28 and 30 are centered at the same time. Thereafter, they displace in opposite directions to reach opposite limits simultaneously and then return to a central position. Then, they travel to the other limits and before returning to the central position.

The oscillating rates for both open and closed stitch yarns is the same. Furthermore, as can be seen by comparing FIGS. 11A, 11B and 11C, the needles and the upper and lower throw bars are all at a central position or reference position simultaneously.

With reference to FIG. 11D, the open stitch yarn is obtained when the cam 136 is mounted on the cam shaft 106 with reciprocation to the right being represented by positive-going traces of the timing diagram. With the cam 136 on the upper cam shaft 106, the throw bars reciprocate at the same rate that they oscillate to form the open stitches. However, when the cam 136 is transferred to the cam shaft 142, the reciprocating rate doubles to produce a complete horizontal reciprocation for each half of an oscillating cycle and form closed stitches around the individual needles. Also noted by comparing the various timing diagrams that the needles and throw bars have a common time at which they pass through a central reference position.

A dotted line in FIG. 11D represent the components of bar motion for bars 172 and 126 as viewed from the left of the bars and using the housing as a reference for reciprocal motion. As both components are reversed, the net motion is identical because the needle displacements on both sides of the knitting machine are identical.

Figure 9:
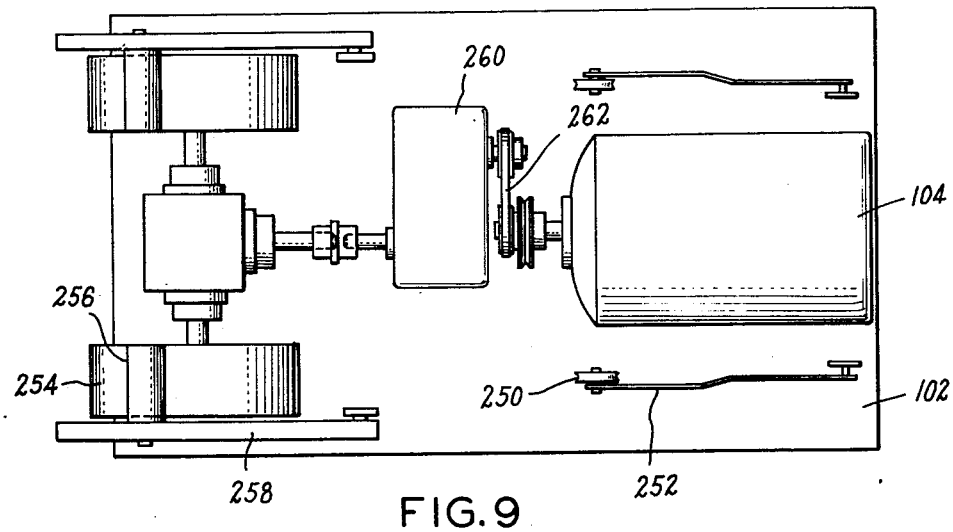
FIG. 9 is a view from line 9—9 in FIG. 6.
Figure 10:
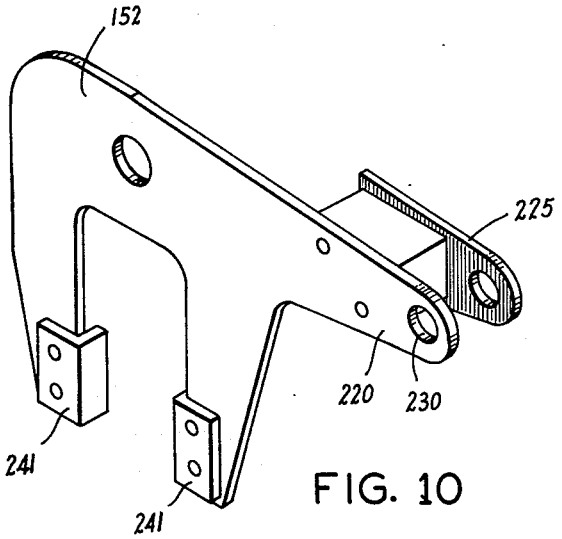
FIG. 10 is a perspective view of a needle lever used in the knitting machine.

As the yarn is knitted in accordance with the sequences shown in FIGS. 2 and 4, it drops downwardly to accumulate below the support plate 102 as shown in FIGS. 1 and 9. A roller guide 250 pivoted on an arm 252 directs the yarn 46 to a feed roller 254. A roller 256 on an arm 258 pivoted below the axis of rotation for the drum 254 guides the yarn and holds it against the surface of the drum 254. After the yarn 46 leaves the drum, it accumulates in a final storage unit 14 which may comprise a shipping cone or other storage device.

The plate 102 supports the drum 254 and the arms 252 and 258 below the upper plate 116. A variable speed reduction unit 260, similar to the torque converter 110 and coupled to the motor 104, drives the drum 254. A belt-and-pulley arrangement 262 couples the reduction unit 260 and the motor 104 to thereby provide some additional control over the tension on the finished yarn as it is knitted.

In summary, my invention is directed to three related aspects of yarn manufacture. My knitted yarn, by virtue of its construction, does not unravel when it is cut. Therefore, no special processing is necessary. The yarn has no inherent torque so it is less susceptible to kinking and breaking during subsequent use and, when knitted into a material, forms straighter rows. Further, the yarn is inherently elastic and the degree of elasticity is easily varied. Finally, the resulting yarn has relatively more bulk than yarns prepared by twisting or braiding.

With regard to manufacturing, my method of knitting yarn incorporates two advantages of twisting and braiding methods. That is, my method allows large quantities of yarn to be taken from a supply section as is possible with twisting methods and produces a continuous finished yarn as provided by braiding methods. However, it overcomes the knotting and extra handling of twisted yarn required because twisting machines have a limited take-up capability. In addition, the constant process interruptions required for replacing spools in braiding machines are eliminated.

Both the knitting method and apparatus are very flexible. A given apparatus can produce a wide range of yarn sizes with a wide range of strands with only minor modification to the apparatus. Both the method and apparatus enable increased production rates which are not significantly affected by changing the strand diameter. This fact, coupled with the fact that process interruptions are minimized, greatly increases machine production efficiency.

Figure 12:
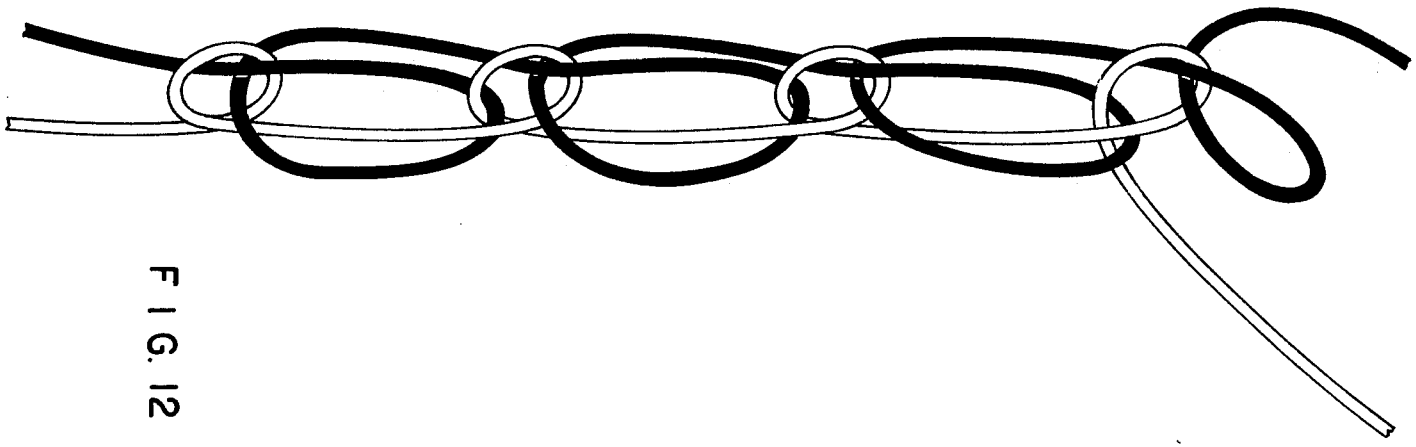
FIG. 12 is an enlargement of a modified form of the knitted yarn as embodied in the present invention.

While I have described a specific embodiment of a knitted yarn and method and apparatus for manufacturing the yarn, many variations are possible. For example, I have found that one latch needle can be removed from the yarn knitting machine. Then the machine produces a flattened yarn. Although the service arms tend to form stitches simultaneously, one stitch is never formed around the missing needle. As a result, the stitches are formed around the one needle axis with successive stitches being formed alternately by the strands as illustrated in FIG. 12. Each stitch is also drawn through a preceding stitch in the axis.

Still other variations are possible. The strand feeding unit may feed each strand at different rates to the different service bars. In some applications, it may be desirable to continuously vary the feed rates during manufacture in a controlled manner. As previously indicated, a strand may comprise one or more knitted yarns, fibers, non-textile filaments or other combination of these elements.

The illustrated method of manufacturing the knitted yarn and apparatus describe simultaneous motion of the service bars and needles so stitches are being formed, drawn through other loops and cast-off simultaneously. It is also possible to separate the operations so that a stitch forms completely before any action to draw the stitch is taken. Different apparatus might also be used to perform the operations described above or in the specific embodiment. Therefore, it is the object of the appended claims to cover all such variations and modifications as come within the true spirit and scope of this invention.

What I claim as new and desire to secure by Letters Patent of the U.S. is:

1. A knitted yarn, comprising first and second strands alternately formed into successive stitches about a common axis, each stitch of said first strand including a loop that is formed by overlapping of portions of said first strand, each stitch of said second strand including a loop through which the loop of the first strand extends, said second strand including a first portion that interlocks with the loop of the next successive loop of the first strand, a second portion of the second strand interlocking with the loop of the first strand that extends through the loop of the second strand, said second portion of the second strand overlapping with said first portion thereof to form the loop of said second strand therewith.

2. A method of knitting a yarn from two separate strands about a common axis, comprising the steps of feeding each of said strands to a single latch needle that defines the axis of said yarn and that is movable in a vertical reciprocating direction, feeding one of said strands to said needle through a first guide that is rotated in a clockwise direction with respect to said needle while simultaneously feeding the other strand to said needle through a second guide that is rotated in a counterclockwise direction with respect to said needle, alternately and successively forming stitches in the strands as they are fed to the vertically reciprocating needle, wherein each stitch of said one strand is defined by a loop that is formed by overlapping of portions of said one strand and each stitch of the other strand includes a loop through which the loop of said one strand extends, a first portion of said other strand interlocking with the loop of the next successive loop of said one strand, a second portion of said other strand interlocking with the loop of said one strand that extends through the loop of said other strand, and the second portion of the other strand overlapping with the first portion thereof to form the loop of the other strand therewith, feeding the strands to said needle at the same controlled rate, and drawings each newly formed stitch of said one strand as defined by the loop thereof through a preceding stitch of the other strand as defined by its loop before forming the next stitch in the sequence.

* * * * *